United States Patent [19]

Muller et al.

[11] Patent Number: 4,965,983

[45] Date of Patent: Oct. 30, 1990

[54] METHOD AND APPARATUS FOR FEEDING STRIPS TO A PACKAGING MACHINE

[75] Inventors: Roland Muller, Remchingen; Manfred Gries, Ettlingen; Roland Klein, Eisingen, all of Fed. Rep. of Germany

[73] Assignee: Sieber Verpackungstechnik GmbH & Co. KG, Reimchingen, Fed. Rep. of Germany

[21] Appl. No.: 305,171

[22] Filed: Feb. 2, 1989

[30] Foreign Application Priority Data

Feb. 18, 1988 [DE] Fed. Rep. of Germany ..... 3805093

[51] Int. Cl.[5] ..... A21C 15/04; B26D 7/06

[52] U.S. Cl. ..... 53/435; 53/450; 53/520; 53/553; 83/27; 83/105; 83/107; 83/157; 83/160; 83/500

[58] Field of Search ..... 83/27, 43, 37, 105, 83/106, 107, 157, 160, 161, 145, 146, 116, 500; 53/435, 450, 520, 553

[56] References Cited

U.S. PATENT DOCUMENTS 4,373,713 2/1983 Loebach ..... 83/105
4,558,557 12/1985 Kuenfuss ..... 53/520

FOREIGN PATENT DOCUMENTS 560747 6/1977 U.S.S.R. ..... 53/435

*Primary Examiner*—W. Donald Bray
*Attorney, Agent, or Firm*—Nixon and Vanderhye

[57] ABSTRACT

A method and an apparatus are described for making individual strips and feeding the strips to a packaging machine for the strips, in particular to a sealing machine, for sealing the strips into a sheet or foil. The individual strips are cut simultaneously from card-like material and by continuous constrained guiding led from the cutting means to the packaging machine. The constrained guiding is provided by magazines with receiving compartments for the strips and clocked transfer means. This makes it possible to obtain a high cutting output and a correspondingly high and exact packaging output. The invention is intended in particular for processing diagnostic test strips.

30 Claims, 5 Drawing Sheets

METHOD AND APPARATUS FOR FEEDING STRIPS TO A PACKAGING MACHINE

BACKGROUND AND SUMMARY OF THE INVENTION

The invention relates to a method and an apparatus for feeding strips to a packaging machine, in particular a sealing machine, at which the strips are individually packed, in particular, sealed in foil.

The strips may consist of various materials, for example paper, cardboard or plastic, so that they are not completely rigid but have a certain flexibility and present corresponding difficulties in manipulation. The strips may be coated with various materials, for example with a single or several different reagents. In particular, the strips are diagnostic test strips.

Hitherto, such test strips were accommodated mainly in a relatively large number in collective packs, for example glasses or metal tubes, and individually removed therefrom for use. However, the test strips cannot then be kept satisfactorily hygienically clean for a relatively long period of time. Test strips have already been packed individually in foil or sheet with the aid of a corresponding machine, in particular sealed in between two sheet pieces. These sheets or foils consist generally of a metal layer (aluminium) which on the outer side can be coated and imprinted and which on the inner side, at least over part of the surface subsequently forming the sealing region, is coated with polyethylene or a hot-sealing lacquer. The individual strips are protected in such a pack against external influences, can be stored for a long time and are easy to use, the price of the strips not being higher, or hardly so, than that of the strips contained in collective packages. The removal of the strips is facilitated by suitable tearing aids. For manufacturing such individual strip packs, suitable packaging machines, in particular sealing machines, are known. The individual strips and two foil webs are supplied the machine, the strips being sealed between the webs and the sealed foil then being cut into individual foil packs. The performance of such packaging machines was hitherto been restricted in that supplying individual strips to the packaging machine was possible only with a limited speed, i.e. a limited number of strips per unit time. The strips were supplied in one web transversely to the running direction and the performance was restricted to about 300 strips per minute if the strips were to be supplied to the packaging machine with satisfactory alignment for forming proper individual packs.

The invention is based on the problem of providing a method and an apparatus with which it is possible to supply accurately to a packaging machine simultaneously a large number of strips with high cycle frequency to achieve a high packing performance with good accuracy. If for example the packaging machine operates with a cycle frequency of 60/min and for each cycle 25 strips can be supplied simultaneously, the result would be a packing performance of 1500/min.

In a preferred embodiment according to the present invention, there is provided an apparatus for feeding strips to a packaging machine comprising means for cutting a card-like material into individual strips disposed parallel to one another, transfer means disposed below the cutting means, including means defining individual, substantially vertically extending, upright compartments, each compartment being adapted to receive a cut strip through an inlet end thereof and discharge a cut strip through an outlet end thereof, at least a portion of the transfer means being mounted for pivotal movement between a generally vertically oriented position, with the compartments extending substantially upright and a generally horizontally oriented position with the compartments extending substantially horizontally. Means are provided for simultaneously ejecting the individual strips out of the compartments at an outlet end thereof when the compartments extend substantially horizontally. Means are also provided for defining a plurality of guide paths for the individual strips adjacent the exit ends of the individual compartments when the compartments lie in substantially horizontal positions for receiving the individual strips whereby the individual strips may be received in the packaging machine disposed at the end of the guide paths.

In a further preferred embodiment according to the present invention, there is provided a method for feeding strips to a packaging machine for packing the strips individually in foil, comprising the steps of substantially simultaneously cutting from a card-like material a plurality of individual strips lying parallel to each other, disposing the plurality of cut strips in upright positions thereof in a transfer means, pivoting the transfer means such that the individual strips lie substantially horizontally adjacent each other, transferring groups of strips from the transfer means under constrained guiding movement to a table for movement of the strips along predetermined guide paths defined by the table and conveying the group of strips substantially simultaneously along the table while constraining the strips for guided conveyance into engagement between a pair of sealing rolls of the packaging machine.

Thus, fundamentally the method and apparatus according to the invention are configured such that for each individual strip to be supplied to the packaging machine a constrained guiding is ensured starting with the cutting of the strips from a card-like material up to entry and gripping of the individual strips in the packaging machine, and a large number of strips can be cut simultaneously parallel adjacent each other and fed with high cycle frequency to the packaging machine.

These and further objects and advantages of the present invention will become more apparent upon reference to the following specification, appended claims and drawings.

BRIEF DESCRIPTION OF THE DRAWING FIGURES

Figure 7:
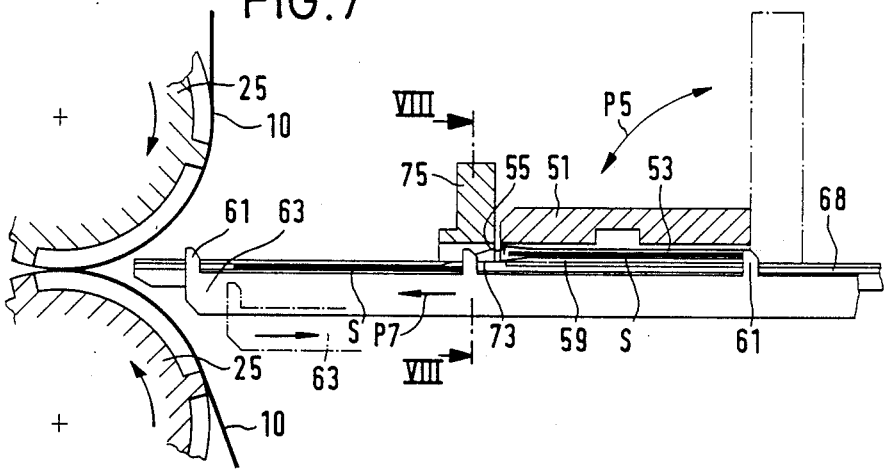
FIG. 7 is a schematic longitudinal cross-sectional view of a pivot magazine and the guide paths leading to the packaging machine.
Figure 7A:
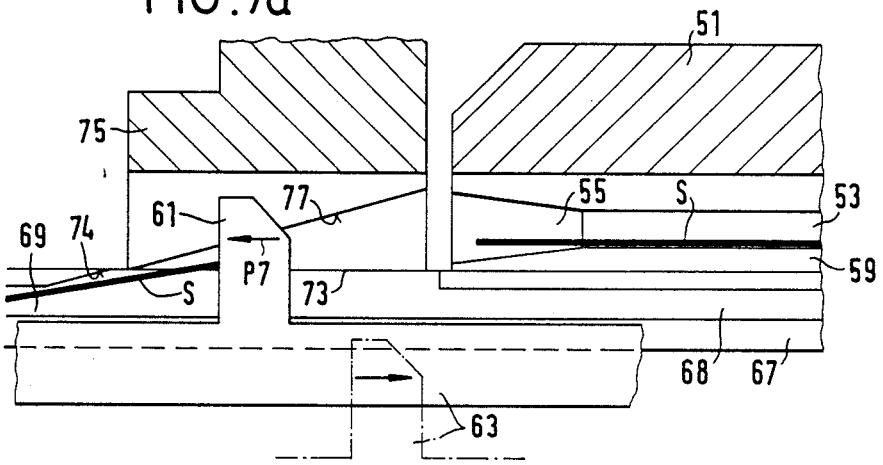
Figure 8:
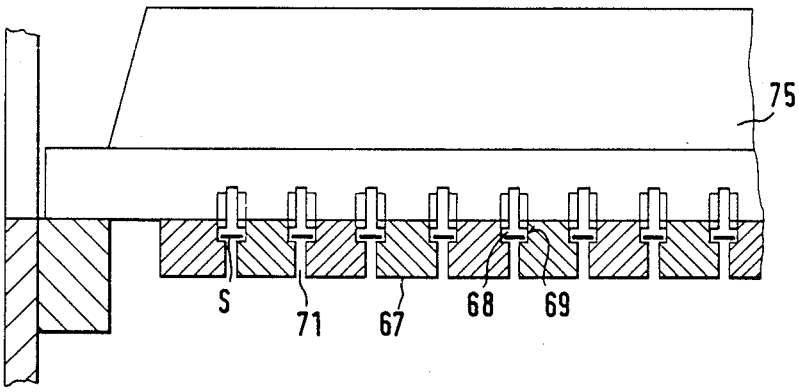

FIG. 7*a* is an enlarged longitudinal cross-sectional view of a detail of FIG. 7; and FIG. 8 is a schematic cross-sectional view along the line VIII—VIII of FIG. 7.

DETAILED DESCRIPTION OF THE DRAWING FIGURES

Reference will now be made in detail to the present preferred embodiment of the invention, an example of which is illustrated in the accompanying drawings.

Firstly, the overall arrangement of a packing machine for individual strips will be described with reference to FIGS. 1 and 2. The individual strips are not shown in FIGS. 1 and 2. For making the strips a suitable starting material in the form of individual cards K is supplied to a card magazine 11 in which the cards K stand vertically upright from a stack. A filling level check means 13 and a switch for stopping the packaging machine when there is no further supply of cards is provided laterally on the card magazine 11. From the card magazine 11, individual cards K are moved with the aid of a pusher into a vertical position above the cutting rolls 17 of a cutting means 19. In the cutting means 19, individual strips are made from the cards K and which strips, with the aid of a transfer means designated generally 14 and described in detail below, are supplied to the entry side of the packaging machine. The individual strips run beneath a check means 12 into the region of two sealing rolls 25. A packing foil or sheet is supplied to each of the two sealing rolls 25 from a foil roll 10, the foil running past a check means 21 to the sealing rolls 25. At each of the check means 21 an adhering table 22 is disposed on which the start of a new foil roll 10 is joined to the end of the used foil. The foil running to the lower sealing roll 25 also runs through a printing mechanism 24 at which it is provided with an imprint desired for the individual strip packs.

Between the sealing rolls 25, the individual strips are sealed between the two foils supplied from the top and bottom. The product thus made then passes to a withdrawal means 26 by which it is first cut into longitudinal strips which are thereafter cut by a transverse cutter 27 into individual product strips 28. Consequently, a material strip cut from the cards K is sealed between two foil portions in each of said product strips 28. If the product strips 28 are not satisfactory they pass via a reject chute 29 out of the machine. The properly sealed product strips 28 run via a transfer station 31 to a cartoning station 32 in which a plurality of product strips 28 are packed together into a carton.

Figure 5:
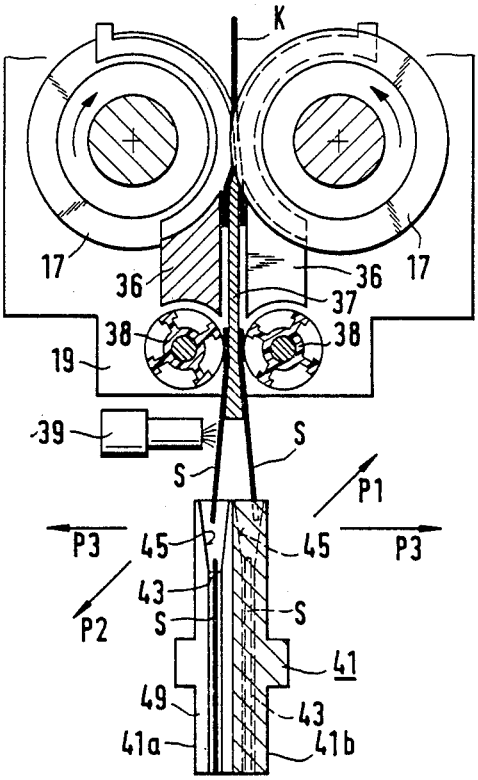
FIG. 5 is a schematic vertical cross-sectional view through the cutting means and a shift magazine disposed therebelow.

The cutting means 19 is shown in FIG. 5 in more detail. The cutting rolls 17 have cutting blades which interengage in a comb-like manner and engage between them a card K. The card is cut up by rolls 17 into individual strips S. Instead of supplying individual cards K to the card magazine 11, a material roll, not shown, could also be provided in front of the card magazine 11 and could first be cut into individual cards K in an additional cutting mechanism. In cutting the individual cards K between the cutting rolls to form individual strips S, due to the comb-like configuration of the cutting rolls, there is a tendency for the individual strips S to spread alternately towards the one side and the other side of the feed plane of the cards K. To prevent these spreading strips from getting stuck between the cutting tolls 17, i.e., between the revolving cutting teeth of the cutting rolls 17 arranged in comb-like manner in each case, a stripper 36 is provided by which the strips S being formed are guided vertically downwardly. In the nip beneath the exit of the two cutting rolls 17, a spreading wedge 37 is disposed. Wedge 37 leads the strips S outwardly against the stripper 36 so that the strips S are guided downwardly in two parallel paths between the spreading wedge 37 and the two strippers 36. There the strips S are guided further downwardly by resilient transport rolls 38 and at the lower end of the spreading wedge 37 spread open with respect to each other to such an extent that the strips S can then enter a shift or displacement magazine 41. The strips S are guided at their trailing ends in the cutting means 19 or between the cutting rolls 17 or the transport rolls 38 until the front leading ends of the strips S have reliably entered the shift magazine 41 so that from the start of the strip formation at the cutting rolls 17 a constrained guiding for the strips S is provided.

Figure 3:
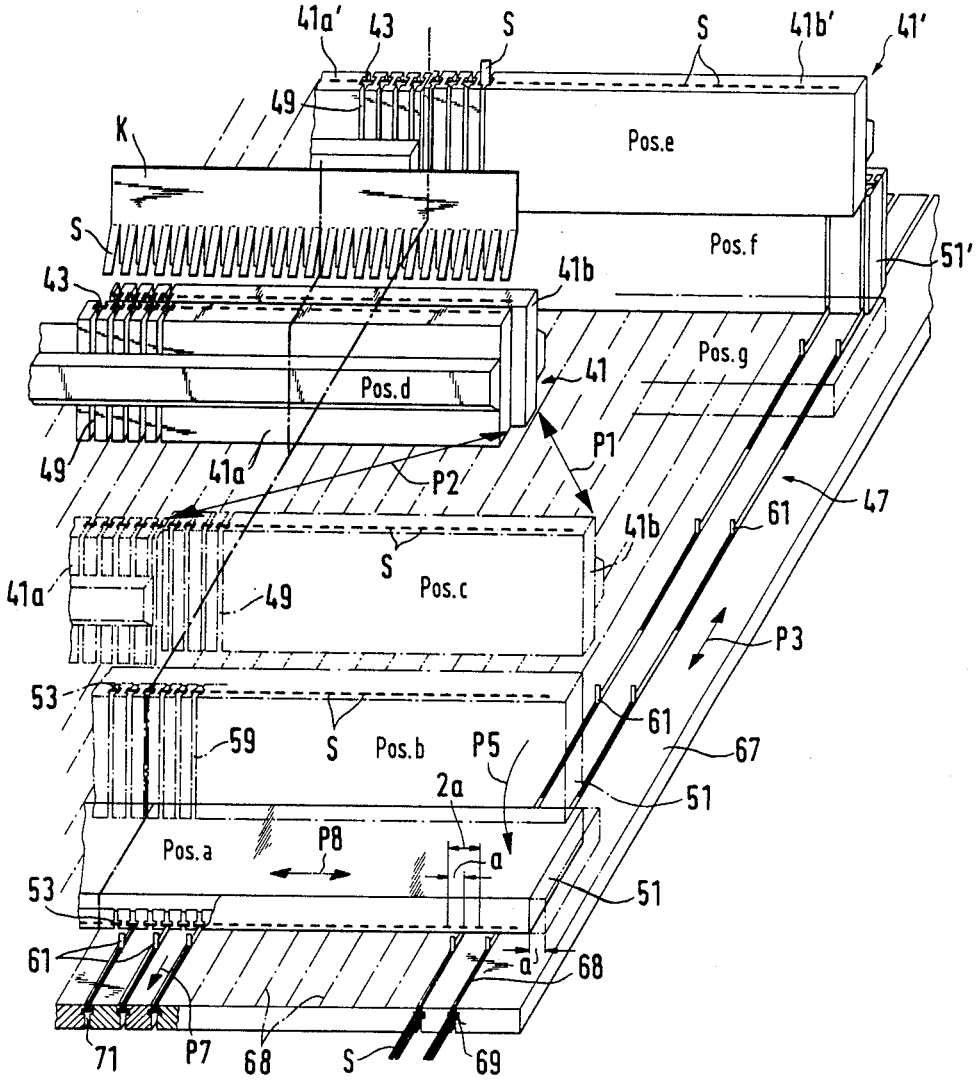
FIG. 3 shows schematically in perspective essential parts of the apparatus according to the invention and their mode of operation.

FIG. 3 illustrates in a perspective view the cutting operation of the cards K by means of the cutting rolls 17 and it can be seen that the strips S being formed spread laterally away from the plane of the cards K. Two adjacent strips are thus spread towards opposite directions.

The shift magazine 41 has individual vertical receiving compartments 43, each of which is associated with one strip S. Due to the spread arrangement of the strips S in the shift magazine 41 two rows of receiving compartments 43 are provided which lie parallel to each other and which are offset with respect to each other by the distance between two adjacent strips S. This results in the arrangement of the receiving compartments 43 illustrated in FIGS. 3 and 6. The receiving compartments 43 extend in each case in the direction of the movement paths of the strips S which are spread with respect to each other by the cutting operation and which are guided via the cutting means 19 described into a path directed substantially vertically downwardly. The shift magazine 41 or the receiving compartments 43 thereof have a vertical length corresponding at least to the length of the longest strip S to be accommodated. As shown in particular in FIGS. 5 and 6 the receiving compartments 43 are provided at their upper ends facing the incoming strips S with inclined portions 45 which altogether are formed substantially in the manner of a funnel to facilitate entry of the strips S into compartments 43.

Figure 6:
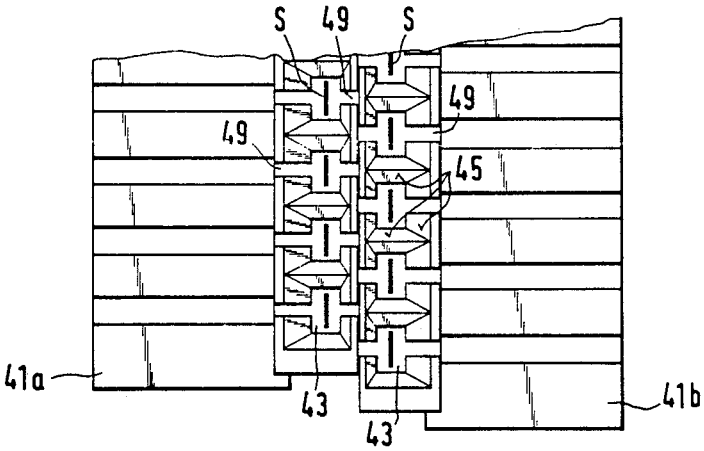
FIG. 6 is a fragmentary plan view of the shift magazine.

As shown in particular by FIGS. 3 and 6, the shift magazine 41 consists of two sections or submagazines **41*a* and 41*b* which are arranged parallel to each other and each of which is intended with a row of receiving compartments 43 to receive a respective row of the strips S cut from a card K. The two sections 41*a* and 41*b* of the shift magazine 41 thus have the same number of receiving compartments 43, said number corresponding to half the number of the strips S to be cut from a card K. The separating plane between the two submagazines 41*a* and 41*b* lies in the cutting plane of the cutting rolls 17. From this location denoted as position d in FIG. 3 the two submagazines 41*a* and 41*b* are transversely displaceable with respect to each other in the direction of the cutting plane through a magazine length as is indicated by the arrows P1 and P2 in FIG. 3. For this displacement the submagazines 41*a* and 41*b* are mounted freely displaceably in a shift station 47. During the transverse displacement along the arrows P1 and P2 the submagazines 41*a* and 41*b* simultaneously execute a longitudinal displacement in the direction of the arrow P3 and moreover the submagazines 41*a* and 41*b* at the end of this displacement movement are further movable perpendicularly to the cutting plane of the cutting rolls 17, which corresponds to the plane of the cards K, in such a manner that the receiving compartments 43 of the two submagazines 41***a* and 41*b* come to lie adjacent each other on a straight line as illustrated in position c in FIG. 3.

Figure 1:
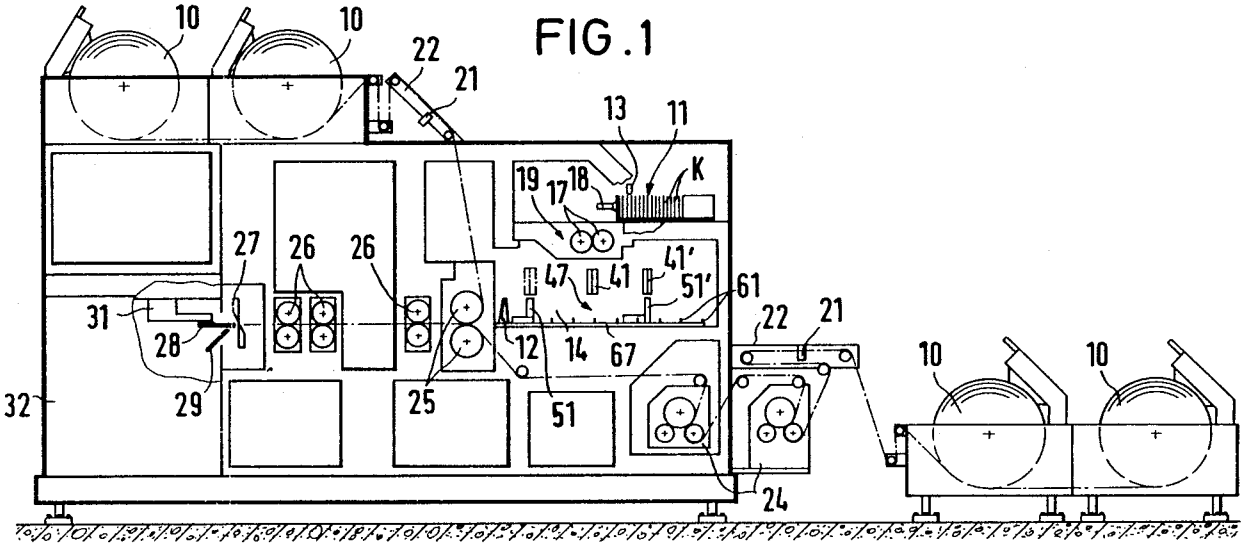
FIG. 1 is a schematic elevational side view of an apparatus according to the present invention in conjunction with a packaging machine for the strips.
Figure 2:
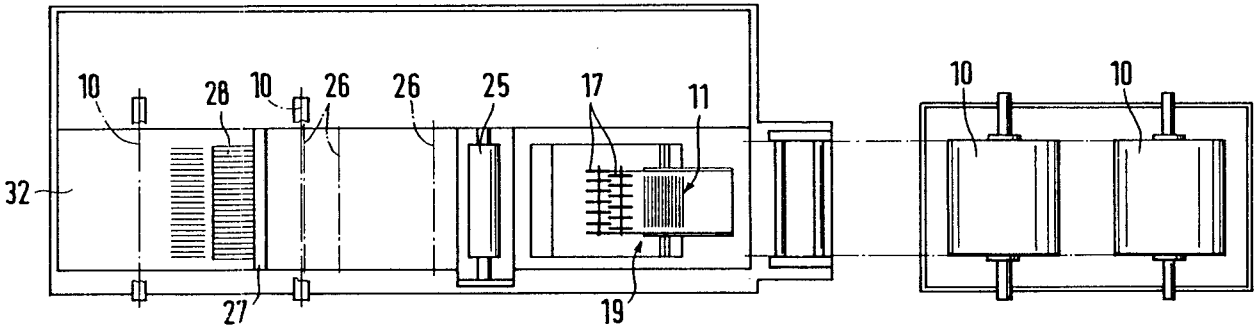
FIG. 2 is a schematic plan view thereof.

As FIGS. 1 and 3 show, at the two ends of the shift station 47 beneath the shift magazine 41, a further magazine 51 is provided for receiving the strips S and said magazine can be pivoted out of the position b into a position a through 90° corresponding to the arrow P5 and accordingly will be referred to hereinafter as pivot magazine 51. Pivot magazine 51 is provided with individual transfer compartments 53 which are associated with the receiving compartments 43 of the shift magazine 41 or the two parts 41*a* and 41*b* thereof. The receiving compartments 43 of the shift magazine 41 are downwardly open but sealed in particular by means of hydraulically movable covering strips (not shown). In the position b the transfer compartments 53 of the pivot magazine thus each form practically a lower extension of the receiving compartments 43 of the shift magazine 41 arranged adjacent each other in a plane. When the sections 41*a* and 41*b* of the shift magazine 41 are located in the position c vertically above the pivot magazine 51 in the position b the strips S can therefore drop or be transferred downwardly out of the receiving compartments 43 into the transfer compartments 53. The number of the transfer compartments 53 of the pivot magazine is equal to the number of the strips S to be cut from a card K and is thus twice as great as the number of the receiving compartments 43 of a section 41*a* or 41*b* of the shift magazine 41.

Similarly to the bevelled entry ends 45 of the receiving compartments 43, the entry ends of the transfer compartments 53 are also bevelled in funnel-shaped manner. This inclined portion 55 of the transfer compartments 53 is shown in FIG. 7*a*.

The cross-section of the receiving compartments 43 and the transfer compartments 53 seen transversely of the longitudinal direction of the strips S is so configured that the individual strips S can each be held therein movably with frictional engagement resulting for example also from the fact that the individual strips S are inclined or tilted in the compartments 43 and 53. Even when they are vertically upright in the receiving compartments 43 and transfer compartments 53, the strips S do not necessarily drop down freely of their own accord but are removed from said compartments by special means so that in this region of the apparatus as well the constrained guiding of the strips S is maintained. Before removal of the strips S from the receiving compartments 43, the lower cover strips thereof are moved away.

To permit a groupwise ejection or pushing out of the strips S from the receiving compartments 43 of the two submagazines 41*a* and 41*b*, the receiving compartments 43 are provided on both sides with open slots 49 (FIGS. 3 and 6) which extend over the height of the submagazines 41*a* and 41*b*. Ejection members, not shown, can engage into said slots 49 and can move along the slots 49 and thus along the receiving compartments 43. These ejection members, not shown, can be arranged laterally of the submagazines 41*a* and 41*b* beneath the cutting means 19 and consist for example of rotatably mounted ejection fingers which run from above downwardly through the slots 49 and the receiving compartments 43 to eject the strips S contained therein downwardly into the transfer compartments 53.

As shown by FIGS. 3 and 6 in the position d, the slots 49 for the ejection members are arranged both on the facing sides of the two submagazines 41*a* and 41*b* and on the opposite sides thereof. After displacement of the submagazines 41*a* and 41*b* into the position c in which the receiving compartments 43 lie on a straight line adjacent each other the slots 49 then likewise lie adjacent each other on both sides of the two submagazines 41*a* and 41*b*. In corresponding manner the ejection members engaging into the slots 49 can be arranged on opposite sides of the submagazines 41*a* and 41*b* or only on one side.

As shown in FIG. 3 the transfer compartments 53 of the pivot magazine 51 have corresponding laterally open slots 59 which, in the horizontal position of the pivot magazine 51, lie in accordance with position a (FIG. 7, 7*a*) at the lower side of the pivot magazine 51. Ejection pushers 61 arranged in groups engage from below into said slots 59 and thus into the transfer compartments 53 and move jointly in the direction of the arrow P7 to remove the strips S in groups from the pivot magazine 51.

Directly beneath the horizontally lying pivot magazine 51 disposed in position a there is a guide table 67 having individual guide paths 68 which are parallel to each other and which are formed by a plurality of guide faces 69 (FIG. 3). The guide faces 69 are aligned with the transfer compartments 53 of the pivot magazine 51 disposed in the horizontal attitude according to position a so that the guide faces 69 of each guide path 68 can each receive a strip S from the transfer compartments 53 of the pivot magazine 51. The guide faces 69 are provided at the bottom with a slot 71 which passes through the guide table 67. Through the slots 71 the ejection pushers 61 project upwardly from below and simultaneously project further upwardly into the open slots 59 and into the transfer compartments 53 of the pivot magazine 51 so as to transfer the individual strips S from the transfer compartments 53 groupwise to the guide paths 68 on movement of the ejection pushers 61 in the direction of the arrow P7. This maintains the constrained guiding for the strips S also in the transfer from the pivot magazine 51 to the guide paths 68.

FIGS. 7 and 7*a* illustrate this transfer operation seen from the side in further detail. It can be firstly seen that the pivot magazine 51 at the entry side for the strips S, which simultaneously represents the exit end for the strips S, has the funnel-like inclined portion 55 which is not shown in FIG. 3. FIG. 8 shows the guide paths 68 of the guide table 67 in cross-section. The guide paths 68 are partially covered at the upper side by corresponding partial areas of the guide faces 69 to prevent the strips S escaping upwardly. On the other hand for passage of the ejection pushers 61 (not shown in FIG. 8) the slot 71 of the guide paths 68 is extended upwardly between the guide faces 69. To permit entry of the individual strips S into the guide paths 68, the guide faces 69 have at their upper side a receiving opening 73 (FIG. 7*a*) at which the upper cover of the guide paths 68 is interrupted. The strips S can enter the guide paths 68 through this receiving opening 73. As FIG. 7*a* shows, the end of the receiving opening 73 remote from the pivot magazine 51 is provided with a downwardly and inwardly directed inclined portion 74 to facilitate the entry and guiding of the strip S into the guide path 68. In addition, in accordance with FIG. 7*a*, between the exit end of the pivot magazine 51 and the inclined portion 74 of the guide path 68, an upper cover 75 is provided over the receiving opening 73. Cover 75 is likewise provided with a downwardly bevelled guide face 77 which, at its right outer end according to FIG. 7*a*, substantially forms an extension of the transfer compartment 53 of the pivot magazine 51 and is inclined from there downwardly towards the inclined portion 74 of the guide path 68. This arrangement practically forms a switchpoint at the transfer point for the strips S between the pivot magazine 51 and the guide paths 68. A strip S is transferred by the ejection pusher 61 from the magazine 51 into the guide path 68 as illustrated in FIG. 7*a*.

FIG. 7 shows that the end of the guide paths 68 is followed by the packaging machine with its sealing rolls 25. Between the sealing rolls 25 the individual strips advanced by the ejection pushers 61 are thus gripped in groups and sealed between the foil webs 10 supplied to the sealing rolls 25.

FIGS. 7 and 7*a* further illustrate that the ejection pushers 61 are arranged on a conveying rail 63 which is movable to and fro and up and down and project from said rail upWardly through the slots 71 of the guide table 67. The conveying rail 63 is disposed beneath the guide table 67 with the guide paths 68 and it operates in time with the packaging machine. Thus, for each packaging operation or sealing operation between the sealing rolls 25, the conveying rail 61 supplies a group of strips S lying parallel adjacent each other by stepwise advancement of the strips along table 67.

As FIG. 3 shows, the number of the guide paths 68 is equal to half the number of the strips cut from a card K and equal to half the number of the transfer compartments 53 in the pivot magazine 51 because a guide path 68 is associated only with every other transfer compartment 53. The number of guide paths 68 is thus equal to the number of the receiving compartments 43 of one of the two submagazines 41*a* and 41*b* of the shift magazine 41. The mutual spacing of the guide paths 68 transversely of the feed direction of the strips S is governed by the width of the finished packed strips 28. With the arrangement described however in the pivot magazine 51 it is possible to accommodate adjacent each other twice as many strips S as can be simultaneously processed adjacent each other by the packaging machine.

If, in accordance with FIG. 3, the spacing between adjacent guide paths 68 is equal to 2*a*, said spacing simultaneously corresponding to the width of the finished packed product strips 28, then the spacing between two adjacent transfer compartments 53 in the pivot magazine 51 is equal to a. To enable the strips S to be ejected also from those transfer compartments 53 which according to FIG. 3 are not served by the ejection pushers 61, the pivot magazine 51 is displaceable transversely of the guide paths 68 in the direction of the arrow P8 through the distance a.

Finally, FIGS. 1 and 3 show that beneath the cutting means 19 with the cutting rolls 17 in the displacement station 47 two identical shift magazines 41 are arranged longitudinally spaced from each other in the direction of the arrow P3. If, in accordance with FIG. 3, the first shift magazine 41 is located in the center position in the shift station 47 the other shift magazine 41' simultaneously lies at the rear end of the shift station 47 at the position e. The distance between the two shift magazines 41 and 41' is invariable. Thus, if the second shift magazine 41' is in the center position according to position d then at the same time the first shift magazine 41 is in the position c. The two shift magazines 41 and 41' are thus displaceable simultaneously with each other alternately to the one or other end of the shift station 47. The second shift magazine 41' has two submagazines 41*a'* and 41*b'* which operate in the same manner as the submagazines 41*a* and 41*b*.

Corresponding to the two shift magazines 41 and 41' beneath each end of the shift station 47, a pivot magazine 51 is disposed, i.e. in position b lies the first pivot magazine 51 and in position f at the other end of the shift station 47 lies a second pivot magazine 51' which is pivotal out of the position f through 90° into the position a. The position g corresponds to the position a of the first pivot magazine 51. After the discharging of the pivot magazines 51 and 51' in the positions a and g the pivot magazines 51 and 51' can again be pivoted back into the vertical positions b and f in order to be able to receive new strips S from the shift magazines 41 and 41'.

As apparent from FIG. 3, the guide paths 68 accordingly extend beneath the two pivot magazines 41 and 41' from the rear end of the shift station 47 (position b) via the front end of the shift station 47 (position b) up to the packaging machine.

Figure 4:
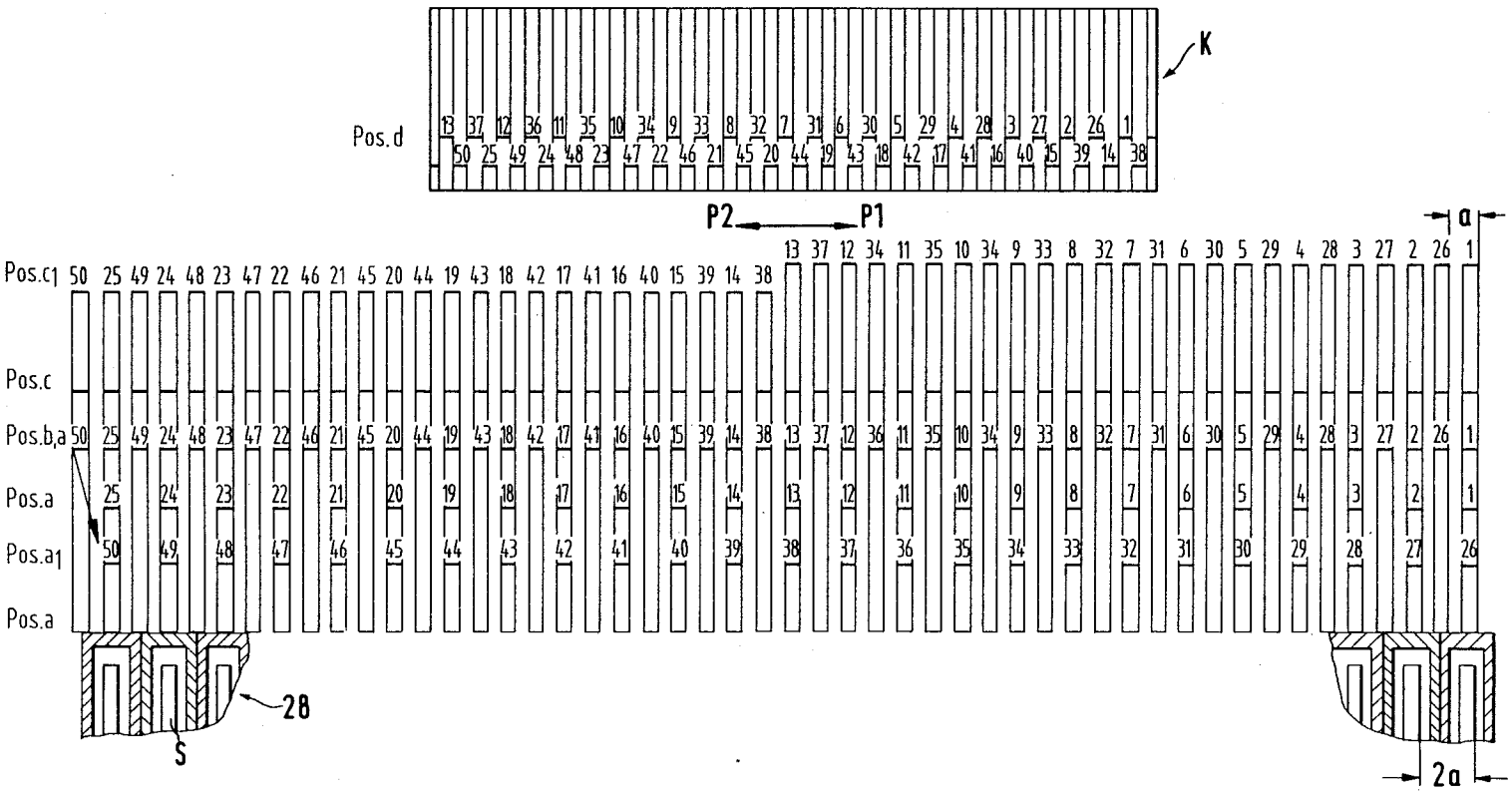
FIG. 4 is a working cycle diagram.

The mode of operation of the apparatus described will now be explained in further detail by way of example with the aid of the sequence diagram of FIG. 4.

It will be assumed that from a material card K 50 strips 1 to 50 of equal width are cut, narrow edge strips being formed as waste at the two ends of the card K. Due to the cutting operation, the strips spread apart as explained above so that two parallel adjacent groups each of 25 strips result which for clarity are designated with the numbers indicated in FIG. 4. The one row of strips with the numbers 1, 26, 2, 27, . . . passes into the one section 41*a* of the shift magazine 41 and the other row of strips with the numbers 38, 14, 39, 15, . . . passes into the other section 41*b* of the shift magazine 41 (position d).

With the two magazine sections 41*a* and 41*b* the two rows of strips are pulled apart in the longitudinal direction of the magazine sections 41*a* and 41*b* (position $c_1$), the mutual spacing of the individual strips remaining unchanged. From the position $c_1$ by shifting the submagazines 41*a* and 41*b* with respect to each other perpendicularly to the cutting plane the two rows of strips are brought to lie adjacent each other on a line (position c). From this position the individual strips drop downwardly out of the submagazines 41*a* and 41*b* or are pushed out of said magazines downwardly by ejection members and pass into the pivot magazine 51 (position b) disposed therebelow. The pivot magazine 51 now pivots through 90° into the position a which is not expressed in the sequence diagram of FIG. 4 by any change in the illustration. Up to this point the mutual spacing of the strips remains unchanged.

In position a, a first group of strips 1 to 25 is now transferred by the ejection pushers 61 into the guide path 68, every other strip being pushed from the pivot magazine 51 into the guide path 68 so that the strips 26 to 50 remain in the pivot magazine 51. Since the ejected strips 1 to 25 have a mutual spacing of 2*a*, the strips 26 to 50 remaining in the pivot magazine 51 also have the same mutual spacing 2*a*. They are however laterally offset with respect to the ejected strips 1 to 25 by the distance a Accordingly, the pivot magazine is now shifted by this distance a into the position $a_1$ transversely of the ejection direction of the strips, whereupon the next group of ejection pushers 61 of the guide table 67 eject the second group of strips 26 to 50 into the guide paths 68. Consequently, in succession two groups of strips 1 to 25 and 26 to 50 move into the guide paths 68 and out of the latter to the sealing rolls 25 of the packaging machine. The empty pivot magazine 51 is then moved back through the distance a out of the position $a_1$ to the position a and pivoted upwardly through 90° into the position b. Thereafter the pivot magazine 51 can again be filled with a row of 50 strips coming from the position c.

The 50 strips cut simultaneously from a card thus pass in two groups each of 25 strips consecutively into the guide paths 68 and to the sealing rolls 25 of the packaging machine. If the machine operates with a frequency of 60/min cycles the conveying rail 63 with the ejection pushers 61 must therefore feed 60×25, i.e. 1500 strips/-min, to the packaging machine. This corresponds to a cutting power of the cutting means 19 of 30 cards/min each to 50 strips. This defines the working frequency of the shift magazines 41 and 41' and of the pivot magazines 51 and 51'. The cutting of the card K into the individual strips S and the further conduction of the strips into the guide paths 68 cannot take place with a working frequency as high as that of the packaging machine because firstly the spreading apart of the strips S on cutting is not possible at this high speed and secondly at excessive conveying speeds the individual strips can become electrostatically charged too much. This would make difficult steps necessary for electrical discharge of the strips. FIG. 5 shows a discharge electrode 39 provided for this purpose at the cutting mean 19.

The shift magazine 41 and the pivot magazine 51 can thus operate with a frequency of 30/min with in each case a single provision of said magazines. Since however a certain amount of time is required for the reciprocation of the magazines, introduction of the strips into the magazines and ejection of the strips from the magazines, it is expedient to provide two shift magazines 41 and 41' and two pivot magazines 51 and 51' and to allow them to operate parallel to each other, thereby enabling their working frequency to be reduced but nevertheless providing the desired high output.

Thus, a few groups of strips are always present in reserve in the magazines. It is only necessary to make the ejection pushers 61 for the two positions a and g run synchronously such that for example by the ejection pushers 61 at the position g only every other field between consecutive ejection pushers 61 is occupied so that the field remaining free there can subsequently be occupied with strips in position a.

In a preferred example, the width of the individual strips S is 5 mm. The distance between adjacent receiving compartments 43 in the shift magazine 41 and the distance between adjacent transfer compartments 53 in the pivot magazine 51 is then a = 10 mm. The distance between adjacent guide paths 68 is accordingly $2a = 20$ mm. Thus, in the packaging machine finished packed strips 28 are made with a pack width of $2a = 20$ mm. The ratio between width of the material strip S and width of the finished seal package 28 is thus 1 : 4. These figures only represent a preferred example of embodiment.

Summarizing, it may be concluded that the singling out of the individual strips S starts in the cutting means 19 itself during the cutting operation by spreading the individual strips S apart at the card K. During the cutting and directly thereafter the strips S are held in a geometrically exactly defined position. The strips enter the shift magazine 41 and are guided therein before said strips are completely cut at the trailing end or before they leave the transport rolls 38 of the cutting means 19. In the shift magazines 41, 41' and in the pivot magazines 51, 51' the strips are continuously held and guided in constrained manner so that they reach the guide paths 68 in exactly defined geometrical array. Here the constrained guiding is taken over by the ejection pushers 61 which move in timed or clocked manner and which feed the strips S in timed or clocked manner in groups to the packaging machine.

In the example of the embodiment illustrated, the transfer means 14 consists of at least one shift magazine 41 and one pivot magazine 51 which is arranged separately therefrom and separately controllable. It is thus possible to deflect the path of movement of the individual strips S emerging substantially vertically from the cutting means 19 with the aid of the pivot magazine 51 through about 90° into the horizontal direction of the guide paths 68.

If the cutting plane of the cutting means 19 is not perpendicular to the guide paths 68 the pivot angle of the pivot magazine has to be correspondingly altered. However, a technical solution also is conceivable in which the shift magazine 41 forms with the pivot magazine 51 a unitary component so that the shift magazine 41 itself would be pivotal through the necessary pivot angle. The shift magazine 41 in such a case would not even have to be displaceable in the direction of the conveying paths 68 in the direction of the arrow P3; instead, the pivot movement of the magazine could take place directly in a position beneath the cutting means 19.

On the other hand, with appropriate association of the cutting plane of the cutting means 19 to the plane of the guide table 67 with the guide paths 68 a pivot movement could be dispensed with, i.e. if the cutting plane lay practically parallel to the plane of the guide path 68 or even coincided with said latter plane In these latter cases the construction of the apparatus could be simplified, then possibly having to accept a reduction in performance. However, the important point is that for the individual cut strips S from the instant of the cutting up to the transfer to the packaging machine a geometrically exactly defined constrained guiding is provided.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Apparatus for feeding strips to a packaging machine comprising:

means for cutting a card-like material into individual strips disposed parallel to one another;

transfer means disposed below said cutting means, including means defining individual, substantially vertically extending, upright compartments, each said compartment being adapted to receive a cut strip through an inlet end thereof and discharge a cut strip through an outlet end thereof;

at least a portion of said transfer means being mounted for pivotal movement between a generally vertically oriented position, with said compartments extending substantially upright and a generally horizontally oriented position with said compartments extending substantially horizontally;

means for simultaneously ejecting the individual strips out of said compartments at an outlet end thereof when said compartments extend substantially horizontally; and means defining a plurality of guide paths for the individual strips adjacent the exit ends of said individual compartments when said compartments lie in said substantially horizontal positions for receiving said individual strips whereby the individual strips may be received in the packaging machine disposed at the end of the guide paths.

2. Apparatus according to claim 1 wherein said transfer means includes a first magazine having individual, generally vertically disposed, receiving compartments, said compartment defining means including a second magazine below said first magazine, said first magazine being disposed below said cutting means for receiving the strips therefrom with said second magazine in said generally vertically oriented position thereof being positioned to receive, in said compartments thereof, the strips disposed in said first magazine.

3. Apparatus according to claim 1 wherein said cutting means comprises two cutting rolls having interengaging cutting blades in a substantially comb-like meshing manner, strippers disposed therebetween for stripping the strips from between said blades, and a spreading wedge disposed beneath said cutting rolls to guide adjacent strips on opposite sides thereof.

4. Apparatus according to claim 1 wherein the strip inlets for said compartments are arranged directly beneath the cutting means a distance shorter than the length of the individual cut strips.

5. Apparatus according to claim 2 wherein said first magazine includes two submagazines arranged in series parallel to each other, each magazine having a number of receiving compartments half as great as the number of strips to be formed simultaneously from the card-like material, the separating plane between the two magazines lying in the cutting plane, with the cut strips alternately lying on opposite sides of the cutting plane, the receiving compartments of the submagazines each extending substantially in the direction of the path of movement of the strips spread apart on opposite sides of the cutting plane, adjacent receiving compartments of the two submagazines being offset with respect to each other in the direction of the cutting plane by the distance between two adjacent strips.

6. Apparatus according to claim 5 wherein said two submagazines are longitudinally displaceable with respect to each other from a position parallel to each other in the direction of the cutting plane by a magazine length and are movable perpendicularly to the cutting plane in such a manner that the receiving compartments of two submagazines lie adjacent each other along a straight line.

7. Apparatus according to claim 2 wherein the receiving compartments of said first magazine are adapted to be open at the bottom and the transfer compartments of said second magazine are open at the top, the transfer compartments of said second magazine forming a continuation of the receiving compartments of said first magazine and arranged adjacent each other in a straight line.

8. Apparatus according to claim 5 wherein the number of the transfer compartments of said second magazine is equal to the number of strips to be cut from the card-like material and twice as great as the number of receiving compartments of one of said submagazines of said first magazine.

9. Apparatus according to claim 2 wherein the inlet ends of the compartments of said first magazine and the inlet ends of the compartments of said second magazine are provided with funnel-like inclined portions.

10. Apparatus according to claim 2 wherein the cross-section of the receiving compartments of said first and second magazines is so configured that the individual strips are held movably therein with frictional engagement with the walls defining said compartments, the walls being spaced from the strips in the compartments a distance greater than a corresponding dimension of the strips.

11. Apparatus according to claim 2 wherein the receiving compartments of said first magazine have laterally open slots for receiving ejection members.

12. Apparatus according to claim 5 wherein said submagazines are longitudinally displaceable realtive to one another, means defining slots disposed on both sides of said two submagazines for receiving the ejection members so that after longitudinal displacement of the submagazines, and arrangement of the receiving compartments in longitudinal alignment one with the other, the slots of the two submagazines lie in registration with one another.

13. Apparatus according to claim 2 including ejection pushers for displacing strips from the compartments of said second magazine, the compartments of said second magazine, when the latter lies in said horizontally oriented position, including slots along its underside open to said compartments for the groupwise engagement of the strips by said ejection pushers disposed through said slots into said compartments.

14. Apparatus according to claim 13 including a guide table having guide faces arranged parallel to each other and defining guide paths for guiding the individual strips, said guide paths in the horizontally oriented position of said second magazine being aligned with the compartments thereof, said guide table having a slot opening into each of said guide paths, ejection pushers disposed in said table slots from below said table and projecting simultaneously upwardly through said table slots and into the slots open at the bottom of the transfer compartments of said second magazine for groupwise transfer of the individual strips from the compartments of said second magazine to said guide paths.

15. Apparatus according to claim 14 wherein the transfer point for the strips between said second magazine in its horizontally oriented position and the guide paths includes receiving openings along the upper side of said guide paths and an upper cover having a guide face for guiding the strips downward from the compartments of said second magazine into the guide paths on said table.

16. Apparatus according to claim 14 including a conveying rail, said ejection pushers being mounted on said rail and project upwardly from said rail, said rail being horizontally and vertically reciprocable and disposed below said guide paths for the strips.

17. Apparatus according to claim 14 wherein the number of said guide paths is equal to the half the number of the strips to be cut from the card-like material, equal to half the number of the transfer compartments of said second magazine and equal to the number of receiving compartments of said first magazine.

18. Apparatus according to claim 17 wherein said second magazine is displaceable transversely of the conveying direction of said guide paths by an amount (a) which is equal to half the distance (*2a*) between two guide paths corresponding to the width of the packed strips.

19. Apparatus according to claim 1 including means defining a shift station below said cutting means, two identical magazines arranged in horizontally spaced relationship and simultaneously displaceable generally horizontally from the center of said shift station alternately to one or the other ends of said shift station;

a second magazine at each end of the shift station and cooperable with one of the identical magazines to receive strips therefrom; and means defining guide paths for the individual strips extending generally horizontally below said second magazine in the direction of the displacement of said pair of magazines toward the packaging machine.

20. Apparatus according to claim 7 including a movable locking strip for closing and releasing the lower ends of the receiving compartments of the lower side of said first magazine.

21. A method for feeding strips to a packaging machine for packing the strips individually in foil, comprising the steps of:

substantially simultaneously cutting from a card-like material a plurality of individual strips lying parallel to each other;

disposing the plurality of cut strips in upright positions thereof in a transfer means;

pivoting said transfer means such that the individual strips lie substantially horizontally adjacent each other;

transferring groups of said strips from said transfer means under constrained guiding movement to a table for movement of the strips along predetermined guide paths defined by the table; and conveying the group of strips substantially simultaneously along the table while constraining the strips for guided conveyance into engagement between a pair of sealing rolls of the packaging machine.

22. A method according to claim 21 including transferring the leading ends of the cut strips in the transfer means during the cutting operation while the rear ends of the strips not yet separated from each other are passing through the cutting means.

23. A method according to claim 21 including providing a first magazine having individual, generally vertically disposed, receiving compartments, and a second magazine having strip receiving compartments below said first magazine, positioning said first magazine to receive the cut strips and positioning said second magazine in a generally vertically oriented position to receive, in said compartments thereof, the strips disposed in the compartment of said first magazine, the step of pivoting, including pivoting said second magazine.

24. A method according to claim 21 including providing two cutting rolls having inter-engaging cutting blades in a substantially comb-like meshing manner, stripping the strips from between said blades, providing a spreading wedge disposed beneath said cutting rolls, and guiding adjacent strips on opposite sides of said wedge.

25. A method according to claim 24 including providing two submagazines in series parallel to each other, each magazine having a number of receiving compartments half as great as the number of strips to be formed simultaneously from the card-like material, the separating plane between the two magazines lying in the cutting plane, alternately disposing the cut strips on opposite sides of the cutting plane, disposing the receiving compartments of the submagazines substantially in the direction of the path of movement of the respective strips spread apart on opposite sides of the cutting plane, and disposing the receiving compartments of said two submagazines in offset relation with respect to each other in the direction of the cutting plane by the distance between two adjacent strips.

26. A method according to claim 25 including longitudinally displacing said two submagazines with respect to each other from a position parallel to each other in the direction of the cutting plane by a magazine length, and displacing said submagazines perpendicularly to the cutting plane in such a manner that the receiving compartments of two submagazines lie adjacent each other along a straight line.

27. A method according to claim 23 including displacing strips from the compartments of said second magazine when in said horizontal position thereof, providing slots along the underside of said horizontally positioned second magazine open to said compartments thereof, and engaging said strips by said ejection pushers disposed through said slots and into said compartments of said second magazine to displace the strips from the compartments of the second magazine.

28. A method according to claim 27 including providing a guide table having guide faces arranged parallel to each other to define guide paths for guiding the individual strips, pivoting said second magazine to align the compartments thereof with the guide paths, said guide faces defining slots in said guide table opening into the slots along the underside of the horizontally positioned second magazine and transferring individual strips from the compartments of said second magazine to said guide paths by displacing ejection pushers disposed in said table slots and projecting into the compartments of said second magazine through the slots thereof when said second magazine lies in said horizontal position along said table.

29. A method according to claim 28 including guiding the strips downward from the compartments of said second magazine into the slots along on said table.

30. A method according to claim 28 including providing a conveying rail, said ejection pushers being mounted on said rail and projecting upwardly from said rail, and horizontally and vertically reciprocating said rail to transfer the strips from the compartments of said second magazine and to advance the strips along the table.

* * * * *